United States Patent [19]

Moulet

[11] 3,994,038

[45] Nov. 30, 1976

[54] TOOTHBRUSH

[75] Inventor: Camille Moulet, Le Cannet, France

[73] Assignee: Bioengineering Research, Luxembourg

[22] Filed: Sept. 23, 1975

[21] Appl. No.: 616,056

[52] U.S. Cl. ..... 15/167 R; 15/201

[51] Int. Cl.[2] ..... A46B 9/04

[58] Field of Search ..... 15/167 R, 167 A, 201, 15/110

[56] References Cited

UNITED STATES PATENTS

| | | | |
|---|---|---|---|
| 1,323,042 | 11/1919 | Gardner | 15/167 R |
| 1,860,924 | 5/1932 | Cooke | 15/167 R |
| 3,691,587 | 9/1972 | Makowsky | 15/167 R |

*Primary Examiner*—Peter Feldman

*Attorney, Agent, or Firm*—Finnegan, Henderson, Farabow & Garrett

[57] ABSTRACT

A toothbrush comprising a single-piece mounting with handle and brush carrier formed by a standard level surface but provided with a profiled slit forming a resilient connecting tongue allowing the brushes to pivot and oscillate according to the pulses transmitted ensures the inter-dental cleansing and building up the base of the teeth.

2 Claims, 2 Drawing Figures

TOOTHBRUSH

BACKGROUND OF THE INVENTION

1. Field of the Invention

The subject of the invention relates to a device for brushing teeth functioning with an oscillating movement which is intended to ensure the inter-dental cleansing and building up the base of the teeth.

2. Description of the Prior Art

In known devices one employs to these ends either rotative brushes or orientable brushes, which in view of their constant obligatory displacement expose the teeth without being able to reach the dental interstices.

SUMMARY OF THE INVENTION

The arrangement according to the invention removes these inconveniences and by means of normal reflex movements comprising of pushing and pulling the brush, allows the utilisation of resistance of even the tufts to orientate the brush by pushing the gums back on the teeth.

It comprises a single-piece mounting with handle and brush carrier formed by a standard level surface but provided with a profiled slit forming a resilient connecting tongue allowing the brushes to pivot and oscillate according to the pulses transmitted.

DESCRIPTION OF THE PREFERRED EMBODIMENT

Figure 1:
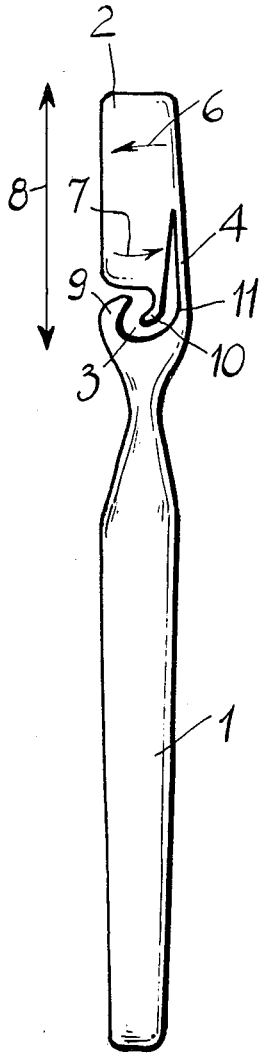
FIG. 1 shows the brush seen in elevation and front view.
Figure 2:
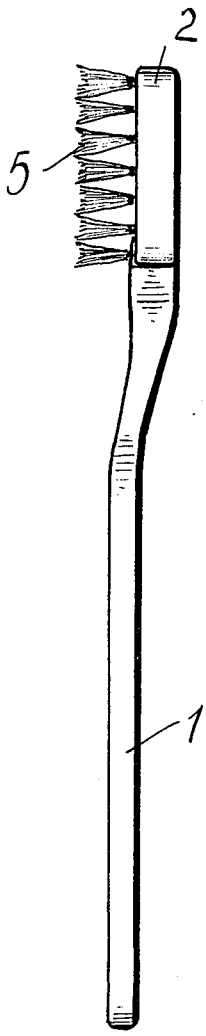
FIG. 2 shows the same object seen in profile.

The brush of the FIGS. 1 and 2 is comprised of a handle 1 adjoining the brush carrying surface 2.

This brush carrying surface comprises a longitudinally orientated profiled slit of decreasing width realising on the one hand a resilient connecting tongue 4 with a mobile stop 10 in the lower portion, and an abutment 9 which is integral with the corresponding handle by its abutment form.

This resilient tongue allows the tongue and the tufts 5 to effect a pivoting movement 6, 7 whilst the whole effects a rectilinear movement 8.

By the standard movement 8, the pulling and pushing of the brush, the bristles on pressing against the teeth, develop a certain resistance. This resistance is transmitted to the tongue 4, which by its resilience tends to make surface 2 pivot, arrows 6, 7.

Nose 9 holds the pivoting surface by limiting the amplitude of movement and which presses sometimes against incline 11, sometimes against the abutment 9. This happens alternatively during all the reciprocal movements of arrows 8.

On rising the bristles lie down and on lowering they brace themselves and push the gum towards the teeth, which has the advantage of pushing the gum back over the teeth, contrary to rotative brushes which expose the teeth.

What is claimed is:

1. An integral toothbrush device functioning with an oscillating movement ensuring cleansing between the teeth, while restoring the gums over the teeth, comprising a tuft-bearing portion;

a handle portion;

an intermediate portion joining the tuft-bearing portion and the handle portion, said intermediate portion including an elongated profiled slit forming a free inward end of said tuft-bearing portion, one side of said slit forming with a side of the device a slender resilient member providing the sole support for said tuft-bearing portion, said slit being orientated longitudinally of the device and decreasing in width along said resilient member for oscillation of the tuft-bearing portion as the brush is reciprocated on its longitudinal axis.

2. The toothbrush device of claim 1 also including means on the sides of said slit cooperating with said resilient member for limiting the oscillation of said tuft-bearing member.

* * * * *